US005553596A

United States Patent [19]

Bednar

[11] Patent Number: 5,553,596

[45] Date of Patent: Sep. 10, 1996

[54] CROSSBOW VIBRATION DAMPING DEVICE

[75] Inventor: William J. Bednar, Akron, Ohio

[73] Assignee: Hunter's Manufacturing, Suffield, Ohio

[21] Appl. No.: 368,701

[22] Filed: Jan. 4, 1995

[51] Int. Cl.[6] ..... F41B 5/12

[52] U.S. Cl. ..... 124/25; 124/88

[58] Field of Search ..... 124/23.1, 24.1, 124/25, 25.6, 86, 88, 89

[56] References Cited

U.S. PATENT DOCUMENTS

| | | | |
|---|---|---|---|
| 3,483,857 | 12/1969 | Jones | 124/25 |
| 4,716,880 | 1/1988 | Adkins | 124/25 |
| 4,722,318 | 2/1988 | Yankey | 124/25 |
| 4,860,719 | 8/1989 | Scheiterlein | 124/25 |
| 4,947,822 | 8/1990 | Jones et al. | 124/25 X |
| 5,092,308 | 3/1992 | Sheffield | 124/25 |
| 5,280,779 | 1/1994 | Smith | 124/88 |

*Primary Examiner*—John A. Ricci
*Attorney, Agent, or Firm*—Oldham & Oldham Co., LPA

[57] ABSTRACT

The invention relates to a crossbow having a vibration damping mechanism which generally comprises a stock member including a barrel at a forward portion thereof, with the barrel used to support an arrow for firing of the crossbow. A riser block assembly is mounted at a forward end of the barrel, with the riser block assembly supporting first and second bow limbs which extend outward from the riser block assembly. The first and second bow limbs carry a bowstring between the outward tips thereof, and the bowstring extends transversely to the barrel. The crossbow further includes a trigger mechanism with the trigger mechanism used to selectively hold and release the bowstring from a cocked position. In the cocked position, the bowstring is drawn in a direction away from the first and second bow limbs to tension the bow limbs. The vibration damping mechanism is disposed to interface at a location between the bow limbs and the stock, such as between the riser block assembly and the barrel or bow limb supports. In this way, vibrations transmitted from the bow limbs upon activation of the trigger mechanism to release the bowstring are damped to minimize vibrations transmitted through the barrel or stock. The vibration damping mechanism of the invention also results in significant noise reduction upon firing of the crossbow.

19 Claims, 2 Drawing Sheets

CROSSBOW VIBRATION DAMPING DEVICE

BACKGROUND OF THE INVENTION

This invention generally relates to crossbows, and more particularly, to an improved crossbow construction which reduces vibrations transmitted to the barrel of the crossbow when firing.

Crossbows in general have been used for many years as a weapon for hunting, fishing, and for target shooting. Crossbow designs have been improved to increase the force with which an arrow is shot, with crossbow designs mimicking compound archery bows. In the compound design, pulleys, wheels, or cams are provided at the tips of the bow limbs associated with the crossbow, having the bowstring supported such that when it is drawn, the draw force against the bow limbs will build to a maximum force and thereafter fall off as the crossbow is fully drawn to ease cocking of the crossbow. The compound design allows greater tension to be imparted to the bow limbs, thereby increasing the force with which an arrow is propelled by the bowstring.

Although the compound design is desirable to increase the force imparted to an arrow shot from the crossbow, drawing of the bowstring to the cocked position stores a tremendous amount of energy within the bow limbs, which is released very quickly upon activation of the crossbow trigger to release the drawn bowstring from its cocked position. To withstand the tremendous forces imposed upon the crossbow limbs, such limbs have been constructed of composite materials having significant strength and flexibility. The crossbow limbs are generally mounted to a riser block formed of a metal, with the riser block then mounted onto the barrel of the crossbow. As significant force is applied to the crossbow barrel when the crossbow is cocked, the barrel itself may be formed of a metal, such that the entire assembly is strong and durable. In such a configuration, it has been found that as the stored energy in the crossbow limbs is released upon shooting of the crossbow, vibrations in the crossbow limbs are transmitted directly to the riser block to which they are attached, and into the barrel of the crossbow. During shooting, a portion of the barrel is used for supporting the crossbow for firing, and the significant vibrations of the crossbow limbs occurring during firing of the crossbow are transmitted to the user via the barrel as well as the entire stock of the crossbow. Such vibrations are undesirable, and can be extremely unpleasant to the user, particularly where the crossbow is shot a number of times. The firing of the crossbow also has heretofore created high levels of noise, which is also undesirable.

Based upon the foregoing, it would be desirable to reduce vibrations transmitted from the crossbow limbs to the barrel and other portions of the crossbow upon firing thereof. It would also be desirable to reduce the levels of noise generated upon firing of the crossbow.

SUMMARY OF THE INVENTION

Based upon the foregoing, it is a main object of the invention to provide a crossbow which dampens vibrations generated from the crossbow limbs upon firing, particularly vibrations which would be transmitted to the barrel and other portions of the crossbow held by the user.

A crossbow having a vibration damping mechanism generally comprises a stock member including a barrel at a forward portion thereof, with the barrel used to support an arrow for firing of the crossbow. A riser block assembly is mounted at a forward end of the barrel, with the riser block assembly supporting first and second bow limbs which extend outward from the riser block assembly. The first and second bow limbs carry a bowstring between the outward tips thereof, and the bowstring extends transversely to the barrel. The stock member further includes a trigger mechanism associated therewith, with the trigger mechanism used to selectively hold and release the bowstring from a cocked position. In the cocked position, the bowstring is drawn in a direction away from the first and second bow limbs to tension the bow limbs. The crossbow further includes vibration damping means disposed to interface at a location between the bow limbs and the stock, such as between the riser block assembly and the barrel or bow limb supports. In this way, vibrations transmitted to the riser block assembly from the first and second bow limbs upon activation of the trigger mechanism to release the bowstring are damped to minimize vibrations transmitted through the barrel or stock. In the preferred embodiment, the vibration damping means may be a bushing comprised of a material which will dampen vibrations transmitted to or from the riser block assembly. The vibration damping mechanism of the invention also results in significant noise reduction upon firing of the crossbow.

BRIEF DESCRIPTION OF THE DRAWINGS

The advantages and objects of the invention will be further understood by reference to the following description of preferred embodiments, taken in connection with the accompanying drawings, wherein.

DETAILED DESCRIPTION OF THE INVENTION

Figure 1:
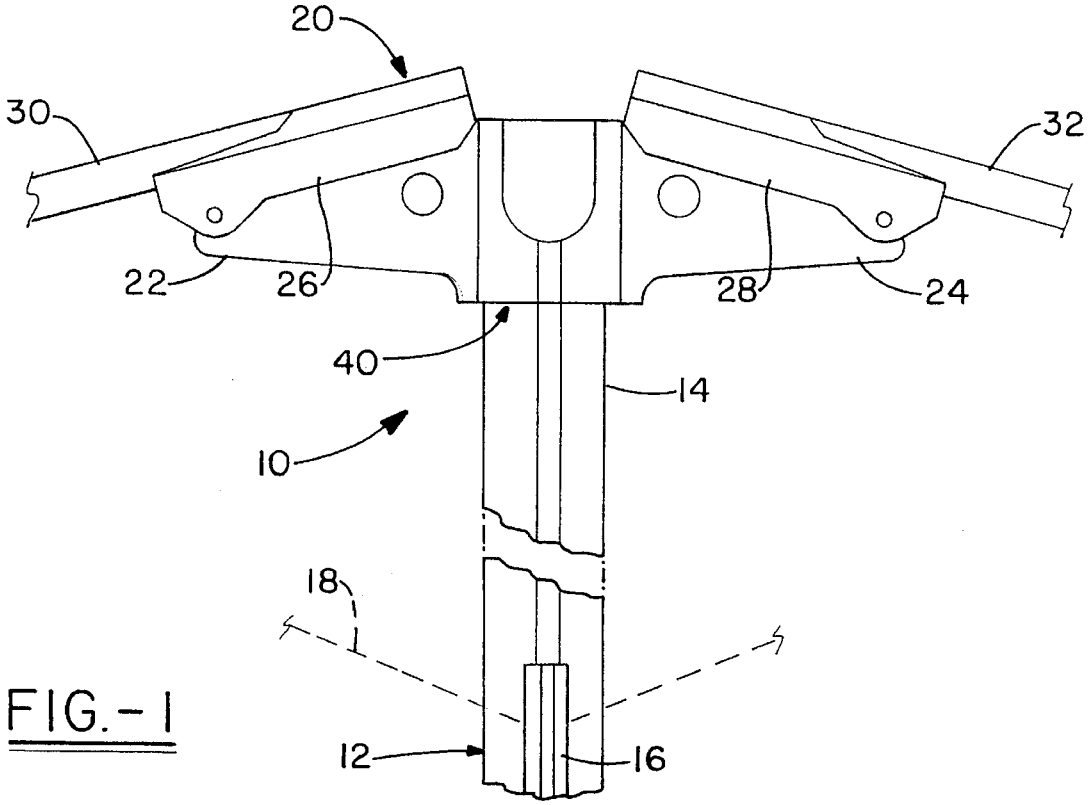
FIG. 1 is a partial top view of a crossbow including vibration damping device according to the invention.

Turning now to FIG. 1, a portion of a crossbow 10 is shown to include a stock member generally designated 12, which may include a butt-stock (not shown) to be rested against the users shoulder for shooting of the crossbow, and a fore-stock or barrel 14, which may be integral to the butt-stock, or may be provided as a separate member secured therewith. In the preferred embodiment, the barrel 14 is a separate member which may be formed of a strong but lightweight material such as aluminum. For example, the barrel 14 may be an extruded member, forming a hollow aluminum barrel which is held by the user for shooting of the crossbow 10. Associated with the stock 12 is a trigger mechanism 16. The trigger mechanism 16 is shown partially, and such trigger mechanisms are generally known in the art, for selectively holding and releasing a bowstring 18. The trigger mechanism of the invention does not constitute a limitation, and any such trigger mechanism may be used as will be appreciated by one skilled in the art. In general, the trigger mechanism 16 will include a user actuated trigger (not shown) which is pulled to selectively release a sear (not shown) used to hold bowstring 18 in the trigger mechanism. Although shown partially in FIG. 1, the barrel 14 has a length which allows the bowstring 18 to be drawn along an upper portion of the barrel and into the trigger mechanism 16 to cock the crossbow 10 for firing.

At the forward end of barrel 14, a riser block assembly generally indicated as 20 is secured to the barrel 14. The riser block assembly 20 includes a pair of outwardly extending arms 22 and 24, each of which carry a limb socket 26 and 28. The limb sockets 26 and 28 in turn support left and right bow limbs 30 and 32 respectively. The bow limbs 30 and 32 extend outward from the limb sockets 26 and 28, and are secured to sockets 26 and 28 by respective limb bolts or other suitable means. The outer tips of the limbs 30 and 32 are attached to the bowstring 18 strung therebetween. The outer ends of the limbs 30 and 32 may be split to accommodate pulley wheels, cams or other known arrangements affixed to the limbs to carry bowstring 18 as well as tension cables in a compound bow arrangement. Any suitable compound arrangement may be used to allow the bowstring 18 to be drawn with an initial force which will build to a maximum limit and thereafter fall off as the crossbow is fully drawn. As the bowstring 18 is drawn, the bow limbs 30 and 32 are tensioned, storing energy which is released upon release of the bowstring from the trigger mechanism 16 to propel an arrow thereby. Energy stored in the limbs 30 and 32 is transferred through the bowstring 16 to the arrow, which is propelled from crossbow 10. The compound bow design allows the energy stored in the limbs 30 and 32 to be increased, to thereby increase the speed at which an arrow is propelled by the crossbow 10. Additionally, the bow limbs 30 and 32 may be formed of a resilient material having a degree of stiffness, the characteristics of which will allow it to bend backwardly upon drawing the bowstring 18 into engagement with the trigger mechanism 16. To increase the speed at which an arrow is propelled from the crossbow 10, the stiffness of the bow limbs 30 and 32 may be increased, to increase the amount of stored energy in the bow limbs upon cocking of the crossbow 10 for firing. As an example, the bow limbs 30 and 32 may be constructed of a composite material such as fiberglass, which is strong and yet flexible to allow drawing of the bowstring 18 into engagement with the trigger mechanism 16 for selective firing of the crossbow 10.

It should be recognized that as crossbow technology has developed, the speed at which an arrow is propelled from the crossbow has been increased, by the above or other methods, generally resulting in a greater amount of energy being stored within the tensioned bow limbs 30 and 32 upon drawing bowstring 18 into the trigger mechanism 16. The sudden release of the bowstring 18 from the trigger mechanism 16 by actuation of the trigger by the user causes the energy stored within the bow limbs 30 and 32 to be quickly released and transferred through the bowstring to the arrow for firing. The release of the bow limbs 30 and 32 from a tensioned condition when the crossbow 10 is cocked and ready for firing thus causes a sudden release of a great amount of energy, causing significant vibrations in the bow limbs 30 and 32. The vibrations or shock generated in the bow limbs 30 and 32 are then transmitted directly to the limb sockets 26 and 28 to which bow limbs 30 and 32 are rigidly secured, and into the riser block assembly 20. From the riser block assembly, such vibrations can be transmitted directly to the barrel 14 which has previously been rigidly secured to the riser block assembly 20, and throughout the stock 12. It should be recognized that as the user supports crossbow 10 for firing by means of the stock 12 and particularly barrel 14, vibrations transmitted into these portions of the crossbow 10 will be directly felt by the user. As development of crossbows continues, the shocks generated by firing of the crossbow 10 have increased, and resulted in a significant disadvantage associated with the increase in the force imparted to an arrow shot from the crossbow 10. The vibrations are unpleasant and undesirable to the user, particularly where the crossbow 10 is fired a number of times. The invention therefore provides vibration damping device 40 which dampens vibrations created in the bow limbs 30 and 32 prior to transmission of the vibrations to the barrel 14 of the crossbow 10.

Figure 2:
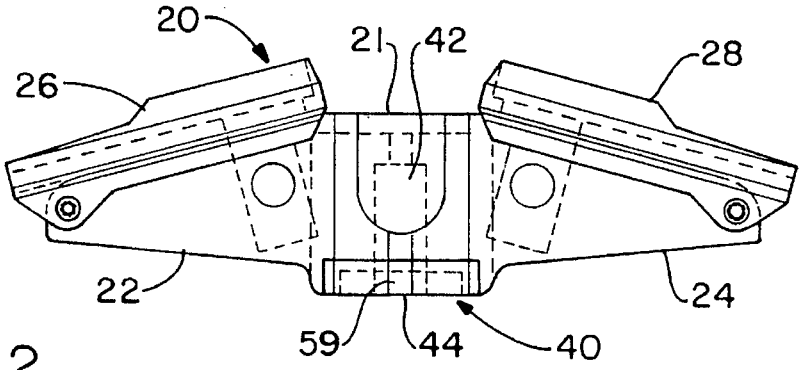
FIG. 2 shows a top view of the riser block and assembled limb sockets of the crossbow for a first embodiment of the invention.
Figure 3:
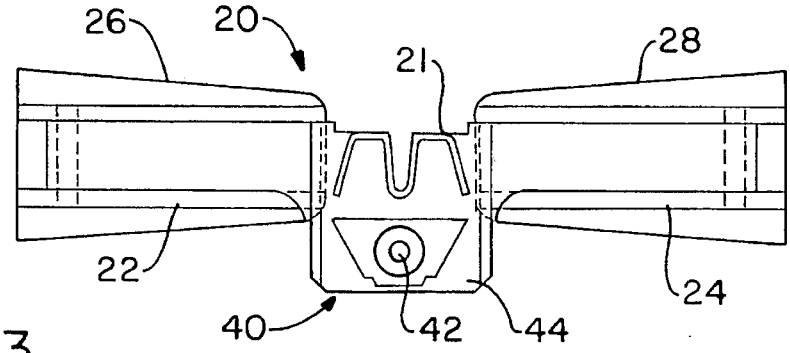
FIG. 3 shows a rear elevation of the riser block assembly shown in FIG. 2.
Figure 4:
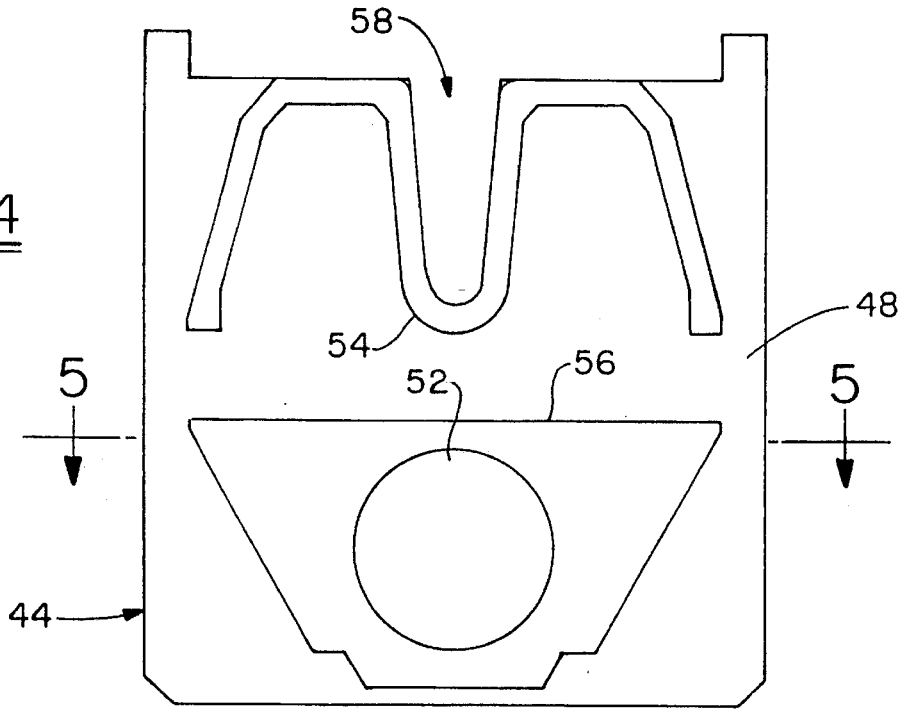
FIG. 4 shows an enlarged view of the riser block bushing according to a first embodiment of the invention.
Figure 5:
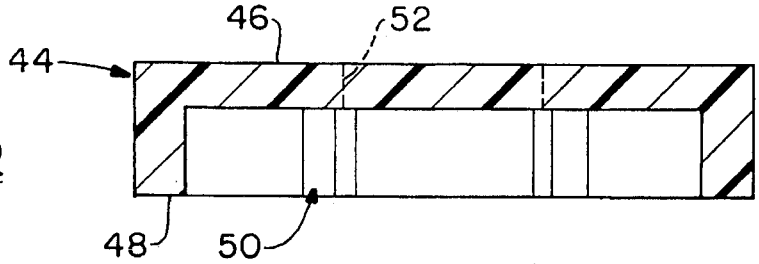
FIG. 5 shows a cross-section through the riser block bushing taken along line 5—5 in FIG. 4.

Turning to FIGS. 2–5, a first embodiment of the invention will be described with reference to the riser block assembly 20 of the crossbow 10. As shown in FIGS. 2 and 3, the riser block assembly 20 includes a main body portion 21 from which arms 22 and 24 extend outward. The main body 21 of the riser block assembly 20 has its rearward portion coupled to the barrel 14 as described with reference to FIG. 1. The barrel 14 may be mounted to the riser block assembly 20 by suitable means such as an assembly bolt through a hole 42 extending through main body 21 of the riser block assembly 20. As the riser block assembly 20 is preferably constructed of a high strength material, such as a metal, vibrations generated from the crossbow limbs during firing of the crossbow are readily transmitted through the limb sockets 26 and 28 and through the riser block assembly 20. The invention therefore comprises vibration damping means 40 provided at the coupling location of the riser block assembly 22 to the barrel 14 of the crossbow 10. As shown in FIGS. 4 and 5, in this embodiment of the invention, the vibration clamping means 40 is a riser block bushing 44 designed to completely interface between the riser block assembly 20 and barrel 14 when assembled together.

An important aspect of this embodiment relates to the material from which bushing 44 is made, which is designed to significantly dampen vibrations transmitted from the riser block assembly 20. In a preferred embodiment, the riser block bushing 44 is constructed of a Nylotron® material produced by BASF Aktiengesellschaft. Alternatively, a glass filled nylon material or a similar material may be used. The material from which bushing 44 is made is preferably compressible and provides a resilient mounting between riser block assembly 20 and the barrel 14 of the crossbow 10. The bushing 44 essentially creates a somewhat resilient cushion between the riser block assembly 20 and the remainder of the crossbow which is held by the user during firing. The material should effectively dampen vibrations transmitted through the riser block assembly 20, with a variety of materials being suitable for this purpose, and contemplated within the invention.

In the preferred embodiment, the riser block bushing 44 is shown in FIGS. 4 and 5, with a forward surface 46, and a rear surface 48. The material from which bushing 44 is made may allow molding of the bushing into the desired shape. In the preferred embodiment, the rear surface 48 has a cavity 50 formed therein. As shown in FIG. 2, the riser block assembly 20 includes a recessed region in which the bushing 44 may be positioned. A corresponding hole 52 is provided in bushing 44 to correspond to hole 42 provided in riser block assembly 20. The bushing 44 has a thickness which completely interfaces with the recess formed in the riser block assembly 20. The bushing 44 may further include mating structures 54 and 56 designed to cooperate with barrel 14 for positively mounting the barrel 14 in association therewith. In the preferred embodiment, the barrel 14 may be constructed of an extruded aluminum, forming a hollow, elongated section. This type of barrel may be inserted into the cavity 50, and may have a corresponding shape to the mating structures 54 and 56 so that the barrel is engaged by the mating structure 54 and 56 about much of the periphery of the barrel. In this manner, the cavity 50 substantially surrounds the barrel to insulate it from any vibrations generated within the riser block assembly 20. In the preferred embodiment shown in the figures, the riser block bushing 44 is also shaped to correspond to the riser block assembly 20, having a recess 58 formed in an upper portion thereof, which corresponds to a similar recess 59 formed in the riser block assembly 20. The barrel 14 would also have a similarly shaped recess along its upper surface for positioning of an arrow along the length of the barrel 14.

Due to the complete interface between the riser block assembly 20 and barrel 14 provided by the riser block bushing 44, direct metal to metal coupling between these members is prevented, and the bushing 44 serves to dampen vibrations which would otherwise be transmitted through this coupling. It should be recognized that the bushing 44 is designed to mate with both the riser block assembly 20 as well as the barrel 14 of the crossbow 10, and the particular configuration shown in the drawings is merely an example of this arrangement. Other shapes or configurations are contemplated, while providing a vibration damping means 40 at the interface between the riser block assembly 20 and barrel 14.

Figure 6:
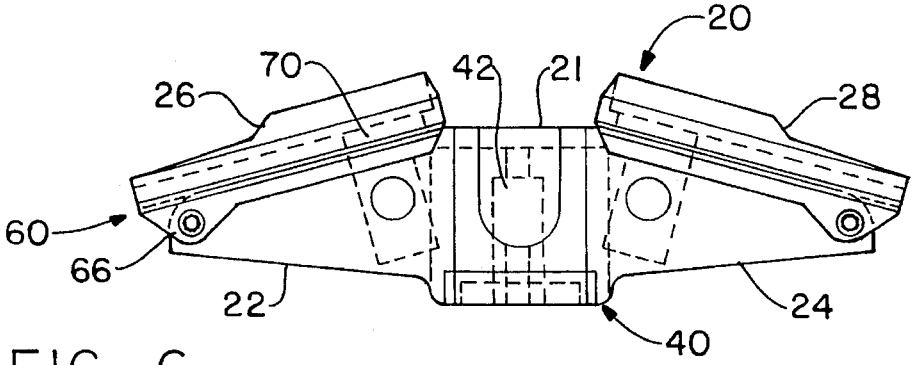
FIG. 6 shows a top view of another embodiment of the crossbow according the invention.
Figure 7:
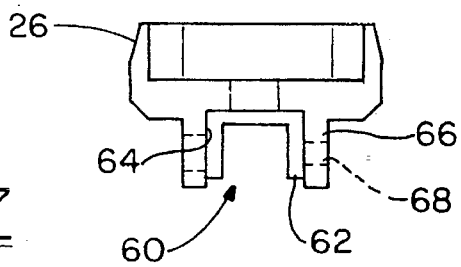
FIG. 7 shows an end elevation of a limb socket according to the embodiment of FIG. 6.

Turning to FIG. 6, another embodiment of the invention is shown, which may be used alone or in conjunction with the riser block bushing 44 described in the previous embodiment. Common elements of this embodiment are referenced similarly to the previous embodiment. Again, the crossbow may include a riser block assembly 20 having a main body section 21 including a mounting hole 42 allowing the riser block assembly to be bolted or otherwise secured to a barrel of a crossbow. Again, the riser block bushing 44, providing a vibration damping function may be used at the interface between the main body section 21 and the barrel of the crossbow. In this embodiment, the limb sockets 26 and 28 include vibration damping means 60 disposed between the sockets 26 and 28 and arms 22 and 24 of assembly 20 to provide damping of vibrations transmitted from the bow limbs to the limb sockets 26 and 28. In FIG. 7, the left limb socket 26 is shown to include a bushing 62 extending along the length of a mounting channel 64. The mounting channel 64 of each limb socket 26 and 28 extends over a portion of the respective arm 22 or 24 in the riser block assembly 20. A flange 66 includes mounting holes 68 allowing attachment of the limb socket of the outer portion of one of the respective arms 22 or 24. Each of the limb sockets 26 and 28 may also be adjustably secured at 70 by a suitable mechanism to allow pivoting of each of the limb sockets 26 and 28 relative to arms 22 or 24 respectively. Such adjustability allows the orientation of the bow limbs to be selectively modified to vary the draw weight of the crossbow. The adjustment mechanism associated with the bow limb sockets 26 and 28 may be of any desired configuration, and may allow selective adjustment between particular bow draw weights. The user may therefore selectively reduce the pounds of force necessary to pull the bowstring, which may be a desirable feature for allowing a variety of users to easily use the crossbow.

In mounting of the limb sockets 26 and 28 to the riser block assembly 20, the bushing 62 interfaces between the U-shaped channel 64 and the respective arm 22 or 24 to insulate the limb socket 26 or 28 from the respective arm 22 or 24. In a preferred embodiment, the limb sockets 26 and 28 are formed of a low density polyethylene or the like. Again, the material with which bushing 62 is made is a vibration dampening material such as Nylotron®, glass filled nylon or a similar material, providing some resiliency and absorption of vibrations at this coupling location.

The foregoing embodiments of the invention, providing damping of vibrations generated in the bow limbs upon firing of the crossbow reduce the shock of firing to enhance use of the crossbow. In addition to minimizing vibrations transmitted through the crossbow upon firing, the vibration damping means of the invention are also found to provide another significant advantage in quieting the crossbow down significantly upon firing. Noise reduction provided for by the vibration damping mechanism is extremely improved, enhancing use of the crossbow. In general, the noise generated upon firing of conventional crossbows has been measured to be approximately 109 dB at a distance of three feet upon firing. Providing the vibration damping means of the invention on the other hand has been measured to produce only 100 dB level noise at a distance of three feet upon firing of the crossbow. This significant reduction in noise associated with firing of the crossbow is based upon use of the vibration damping means comprising the riser block bushing 44 described with reference to the first embodiment of the invention. The use of the bushing 62 in the embodiment of FIG. 6 would also provide noise reduction either alone or used in conjunction with the bushing 44 if desired.

While the vibration damping mechanism of the invention has been shown in particular configurations, it should be understood that configuration may be changed or modified while providing the various desired characteristics thereof. Thus, for example, vibration damping means may be provided in association with an assembly bolt or like securing means used to secure the riser block assembly 20 to the barrel 14 of the crossbow. Although the invention has been illustrated and described with specific reference to preferred embodiments thereof, it is to be understood that various changes may be made without departing from the scope of the invention as defined in the following claims.

What is claimed is:

1. A crossbow having a vibration damping mechanism comprising, a stock member including a barrel at a forward portion thereof, said barrel supporting an arrow for firing of said crossbow, a riser block assembly mounted at a forward end of said barrel, said riser block assembly supporting first and second bow limbs extending outward, said first and second bow limbs carrying a bowstring between the outward tips thereof, and extending transversely to said barrel, said stock member further having a trigger mechanism associated therewith to selectively hold and release said bowstring from a cocked position in which said bowstring is drawn in a direction away from said first and second bow limbs to tension said bow limbs, and vibration damping means disposed between said riser block assembly and said barrel such that vibrations transmitted to said riser block assembly from said first and second bow limbs upon activation of said trigger mechanism to release said bowstring are damped to minimize vibrations transmitted to said barrel.

2. A crossbow as in claim 1, wherein, said vibration damping means is a bushing member configured to form a substantially complete interface between said riser block assembly and said barrel, said bushing member being formed of a compressible material, providing a resilient interface between said riser block assembly and said barrel, with vibrations generated in said riser block assembly upon firing of said crossbow being damped by said bushing member.

3. A crossbow as in claim 2, wherein, said bushing member is constructed of a Nylotron® material.

4. A crossbow as in claim 1, wherein, said riser block assembly has a recess formed therein, in which said vibration damping means is disposed, with said barrel being coupled to said riser block assembly through said vibration damping means at the location of said recess in the rear surface thereof.

5. A crossbow as in claim 1, wherein, said riser block assembly is made of a metal material, and at least said barrel of said stock member also being constructed of a metal material, wherein said vibration damping means is disposed between said riser block assembly and said barrel to substantially prevent metal to metal contact between said riser block assembly and said barrel.

6. The crossbow as in claim 1, wherein, said vibration damping means comprises a bushing disposed between said riser block assembly and said barrel, said bushing including at least one mating structure for mating with said barrel, said at least one mating structure engaging at least a portion of said barrel to substantially insulate it from vibrations generated within said riser block assembly.

7. The crossbow as in claim 1, wherein, said vibration damping means reduces noise generated upon firing of said crossbow.

8. A crossbow having a vibration damping mechanism, comprising, a stock member including a barrel at a forward portion thereof, said barrel supporting an arrow for firing of said crossbow, a riser block assembly mounted at a forward end of said barrel, said riser block assembly including first and second limb sockets for supporting first and second bow limbs extending outward from said riser block assembly, said first and second bow limbs carrying a bowstring between the outward tips thereof, vibration damping means disposed between said first and second limb sockets and said riser block assembly, such that vibrations transmitted to said first and second limb sockets from said first and second bow limbs upon firing of the crossbow are damped to minimize vibrations transmitted through said riser block assembly.

9. A crossbow as in claim 8, wherein, said vibration damping means is a bushing member configured to form a substantially complete interface between said first and second bow limbs and said first and second limb sockets, said bushing member being formed of a compressible material, providing a resilient interface between each of said bow limbs and said limb sockets respectively, with vibrations generated in said first and second bow limbs upon firing of said crossbow being damped by said bushing member.

10. A crossbow as in claim 9, wherein, said bushing member is constructed of a Nylotron® material.

11. A crossbow as in claim 8, wherein, said first and second limb sockets having a recess formed therein, in which said vibration damping means is disposed, with said limb sockets being coupled to said riser block assembly through said vibration damping means at the location of said recess in said limb sockets.

12. A crossbow as in claim 8, wherein, said riser block assembly is made of a metal material, and said first and second limb sockets are constructed of a polymeric material, wherein said vibration damping means disposed between said riser block assembly and said limb sockets substantially prevents direct contact between said riser block assembly and said limb sockets.

13. The crossbow as in claim 8, wherein, said vibration damping means reduces noise generated upon firing of said crossbow.

14. A vibration damping mechanism for a crossbow having a pair of bow limbs carrying a bowstring therebetween, a limb mounting member for supporting the bow limbs, and a stock portion held by the user for firing of the crossbow, the vibration damping mechanism comprising, at least one bushing member mounted in association with said limb mounting member in at least one location between said bow limbs and said stock portion to damp vibrations generated by said bow limbs upon firing of said crossbow, said at least one bushing member being made of a compressible material and forming an interface at said at least one location between said bow limbs and said stock portion.

15. The vibration damping mechanism as in claim 14, wherein, said limb mounting member is a riser block assembly, and said stock portion includes a barrel at a forward portion thereof, wherein said at least one bushing member is mounted to interface between said riser block assembly and said barrel such that vibrations transmitted to said riser block assembly from said bow limbs supported thereby are damped to minimize vibrations transmitted to said barrel.

16. The vibration damping mechanism of claim 14, wherein, said limb mounting member is a riser block assembly including a pair of limb sockets for supporting said pair of bow limbs, and said at least one bushing member is mounted between said limb sockets and said riser block assembly, such that vibrations transmitted to said limb sockets from said bow limbs are damped to minimize vibrations transmitted through said riser block assembly from said bow limbs.

17. The vibration damping mechanism of claim 14, wherein, said at least one bushing member is made of a Nylotron® material formed to substantially completely interface at said at least one location between said bow limbs and said stock portion.

18. The vibration damping mechanism as in claim 14, wherein, said at least one bushing member includes at least one mating structure for mating with the portions of the crossbow in said at least one location between said bow limbs and said stock portion.

19. The vibration damping mechanism as in claim 14, wherein, said at least one bushing member reduces noise generated upon firing of said crossbow.

* * * * *